US006826810B2

(12) United States Patent
Ichikawa et al.

(10) Patent No.: US 6,826,810 B2
(45) Date of Patent: Dec. 7, 2004

(54) SEPARABLE BOTTOM END STOP ASSEMBLY FOR SLIDE FASTENER

(75) Inventors: Nobuhiro Ichikawa, Toyama-ken (JP); Miyako Tamura, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/427,594

(22) Filed: May 1, 2003

(65) Prior Publication Data

US 2003/0213106 A1 Nov. 20, 2003

(30) Foreign Application Priority Data

May 20, 2002 (JP) ..... 2002-145065

(51) Int. Cl.[7] ..... A44B 19/36

(52) U.S. Cl. ..... 24/433; 24/381; 24/416; 24/390; 24/434; 24/435

(58) Field of Search ..... 24/433, 434, 435, 24/390, 381, 416

(56) References Cited

U.S. PATENT DOCUMENTS

| | | | | | |
|---|---|---|---|---|---|
| 1,704,579 | A | * | 3/1929 | Sanford | 24/433 |
| 2,039,976 | A | * | 5/1936 | Norton | 24/434 |
| 2,203,005 | A | * | 6/1940 | Wittenberg et al. | 24/434 |
| 4,078,279 | A | * | 3/1978 | Heimberger | 24/434 |
| 4,139,927 | A | | 2/1979 | Heimberger | |
| 4,221,026 | A | * | 9/1980 | Kanzaka | 24/433 |
| 4,232,430 | A | * | 11/1980 | Friedberg | 24/434 |
| 4,742,603 | A | * | 5/1988 | Kasai | 24/433 |
| 6,009,602 | A | | 1/2000 | Terada | |
| 6,088,888 | A | * | 7/2000 | Oda | 24/433 |
| 6,510,595 | B2 | * | 1/2003 | Matsushima et al. | 24/433 |
| 2001/0047574 | A1 | | 12/2001 | Matsushima et al. | |

FOREIGN PATENT DOCUMENTS

| | | |
|---|---|---|
| EP | 0 917 837 A2 | 5/1999 |

* cited by examiner

*Primary Examiner*—Victor Sakran
(74) *Attorney, Agent, or Firm*—Everest Intellectual Property Law Group; Michael S. Leonard

(57) ABSTRACT

The separable bottom end stop assembly has male and female members engageable with and releasable from each other in a front-to-back direction thereof. A slide plate of the male member has an engagement leg portion projected therefrom, while a sliding plate of the female member has an engagement hole. Sliding surfaces are respectively formed at peripheries of the engagement leg portion and the engagement hole of the slide plates. Each of the slide surfaces is formed with steep incline surfaces and a gentle incline surface. With the cam mechanism, when the male member and the female member are pressed from both surfaces thereof, an insert plate disposed at one of the male member and the female member is automatically guided to an inside of the slider held by a holding portion disposed at the other of the male member and the female member, which simultaneously causes the slider to start moving.

7 Claims, 14 Drawing Sheets

SEPARABLE BOTTOM END STOP ASSEMBLY FOR SLIDE FASTENER

BACKGROUND OF INVENTION

1. Field of the Invention

The present invention relates to separable bottom end stop assembly of a slide fastener. More particularly it relates to separable bottom end stop assembly of a lateral-inserting type slide fastener in which one of the separable bottom end stops attached to a lower end of a fastener stringer is a male member and the other is a female member, and after the male member and the female member are engaged from both surfaces of the fastener surface by a snapping system, the male member and the female member are caused to join up against each other from the transverse direction of the fastener, thereby fitting the fastener stringer inside the slider.

2. Prior Art

In the separable bottom end stop assembly of a slide fastener which has been used in the past, a box pin and a box are attached to an end portion of one of left and right fastener stringers and an insert pin is attached to the other fastener stringer. When the left and right fastener stringers are to be closed, the slider is slid so as to contact the box, and then the insert pin is inserted into the element guide groove of the slider. Next, after the insert pin is inserted into the box, the slider is pulled upwards and caused to slide and the closing operation is thereby carried out. However, in this type of separable bottom end stop assembly in which the insert pin must be inserted in the box, the insertion operation is extremely difficult for children and elderly people.

One known separable bottom end stop assembly which can be operated simply is a lateral-inserting type in which a male member having a projecting pin and a female member having a socket are provided at an end portion of the right and left fastener stringers so as to be engaged with each other, and the fastener stringer is fit-inserted from the side of the slider and thereby closed. This lateral-inserting type separable bottom end stop is disclosed, for example, in the specification of U.S. Pat. No. 4,139,927, which is shown in FIG. 21. In the disclosed separable bottom end stop, an incline surface having a screw-like configuration is provided at a portion of the periphery of each of the pin 110 and socket 112 of the male member 107 and the female member 108 which are provided at end portions of the left and right fastener stringers 102, 102. When the right and left fastener stringers 102, 102 are rotated about the pin 110, the female member 108 moves toward the pin 110 of the male member 107, so that the engagement and separation operation of the male member 107 and the female member 108 can be carried out.

In the separable bottom end stop of the above-described slide fastener which is shown in FIG. 21, when the right and left stringers 102, 102 are rotated in the closing direction around the pin 110 after the pin 110 and the socket 112 are engaged, it is necessary to lead one of the fastener stringers 102, 102 into the slider 103 using the hands in order to fit-insert the fastener stringer 102 into the slider. This is because the screw-shaped incline surface is formed at a fixed angle. Further, in order to rotate the fastener stringer 102 in the opposite direction and separate the pin 110 from the socket 112, the fastener stringer 102 must be rotated to a great extent, or else the fastener stringer 102 at the socket side must be twisted and detached. Thus there is the problem that the engagement and separation operations are extremely difficult.

SUMMARY OF INVENTION

The present invention obviates the aforementioned problems and has a principal object to provide a lateral-inserting type separable bottom end stop assembly of a slide fastener in which the engagement and separation operations are extremely simple and particularly, children and elderly people can perform the operation of closing of the left and right fastener stringers in a simple manner. That is to say, it is a principal object of the present invention to provide a separable bottom end stop assembly of a slide fastener in which the male member and the female member comprising the separable bottom end stop assembly can be engaged from both front and back directions, and by pulling together the male member and the female member and pressing both front and back surfaces thereof, the fastener stringers are closed easily due to cam mechanism, thereby causing initial movement of the slider, and in which separation of the left and right fastener stringers can be easily prevented, and further the separation and release of the left and right fastener stringers can be easily carried out.

Still another object of the invention is to provide a separable bottom end stop assembly of a slide fastener which automatically, speedily and accurately guides an insert plate to an inner portion of the slider which is held by a holding portion which opposes the insert plate.

Still another object of the invention is to provide a separable bottom end stop assembly of a slide fastener in which by specifying the configuration of a sliding surface of slide plate of the male member or the female member, the operation can be effective and accurate, and the separation of the male member and the female member can be carried out simply.

Still another object of the invention is to provide a separable bottom end stop assembly of a slide fastener in which by specifying the surface configuration of the slide plate of the male member or the female member, the engagement and separation of the male member and the female member and the opening and closing of the fastener chain can be carried out smoothly and easily.

Still another object of the invention is to provide a separable bottom end stop assembly of a slide fastener in which by specifying the surface shape of the male member or the female member, the operation of initial movement of the slider attached at the separable bottom end stop assembly can be started simply and reliably using the finger tips.

Still another object of the invention is to provide a separable bottom end stop assembly of a slide fastener in which by specifying the configuration of the slider which is adapted to be mounted to the fastener chain, even children and elderly people can carry out the engagement and separation operation smoothly while the male member and the female member are visible.

The above described objects can be attained by a basic feature of the present invention, that is, a lateral-inserting type separable bottom end stop assembly which comprises a male member and a female member which are engageable with and releasable from each other. The male member is provided with a first slide plate from which an engagement leg portion projects, while the female member is provided with a second sliding plate in which an engagement hole is formed to be fitly engaged with the engagement leg portion. First and second sliding surfaces are formed respectively at the peripheries of the engagement leg portion and the engagement hole. At the time of engagement, the male member and the female member are rotatable relatively with the first and second sliding surfaces thereof being in slide contact with each other. Each of the first and second slide surfaces is formed with a steep incline surface and a gentle incline surface. The steep incline surface and the gentle incline surface serve to automatically advance an insert plate which is disposed at one of the male member and the female member to an inside of a slider which is held by a holding portion which is disposed at the other of the male member and the female member when the first and second slide plates are pressed from both surfaces thereof.

With such structure, by simply pressing the first and second slide plates of the male member and the female member which are in an engaged state from the front and the back, the insert plate can be automatically and speedily moved towards the slider which is held at the holding portion due to the action of the cam. Consequently the operation can be carried out easily even by children and elderly people or by using only one hand. Further, when the male member and the female member are opened to a certain extent, the male member and the female member can be automatically taken out from each other due to the action of the cam, thereby making the engagement and release operation extremely easy.

Furthermore it is preferable that the steep incline surface disposed at each of the slide surfaces is continuous to the gentle incline surface, and the steep incline surface automatically advances the insert plate toward the slider which is held at the holding portion when the first and second sliding plates are pressed from both surfaces thereof, and the gentle incline surface automatically guides the insert plate to the inside of the slider to be accommodated therein. The steep incline surface causes the insert plate to be automatically and speedily brought in close proximity with the slider which is held at the holding portion. Further, the gentle incline surface maintains the action of the steep incline surface and guides the insert plate which is in contact with the slider to the inside of the slider automatically and accurately so that it is accommodated therein.

Here, the "steep incline surface" is a surface having a larger inclination than the "gentle incline surface".

Still further, it is preferable that the steep incline surface disposed at each of the first and second slide surfaces has an elevation angle of 50–70 degrees, and the gentle incline surface has an elevation angle of 5–10 degrees. Further, it is preferable that each of the first and second slide surfaces is provided with an upper step horizontal surface and a lower step horizontal surface which are disposed through a step. Consequently the engagement and release of the male member and the female member can be achieved easily and simply under optimum conditions.

Furthermore it is preferable that there are provided a first steep incline surface, a gentle incline surface, further preferably a second steep incline surface, which are inclined at different angles with respect to the horizontal surfaces, successively in the direction from the lower step horizontal surface towards the upper step horizontal surface. Consequently the insert plate can be automatically and speedily brought in close proximity with the slider which is held at the holding portion more easily, and can be guided and inserted into the slider automatically and accurately.

Still further, it is preferable that each of the slide surfaces is provided with a vertical surface at a holding portion or an insert plate side thereof, and the upper step horizontal surface and the lower step horizontal surface are provided on both sides of the vertical surface, and the steep incline surface has a starting point which is between 160° and 170° from the vertical surface about the center of the engagement leg portion and the engagement hole, and the gentle incline surface is provided between 50° to 600 from an end point the steep incline surface. Consequently the steep incline surface and the gentle incline surface are disposed at the optimal positions, so that the advancing operation of the insert plate can be carried out accurately and the female member can be separated from the male member naturally and without resistance.

Still further it is preferable that when the engagement leg portion of the male member and the engagement hole of the female member are engaged and the insert plate of the female member is fit-inserted into an insert recess groove provided in the holding portion of the male member, grip portions are formed with an outer side edge of a front surface of the first slide plate of the male member and an outer side edge of a front surface of the second slide plate of the female member respectively such that said grip portions form thick portions. Consequently the separable bottom end stop assembly can be easy to grip, so that all the operations can be carried out easily.

Still further it is preferable that a surface of the second slide plate of the female member facing the insert plate has a gentle slant, which pushes the slider forward when the operation for closing the male member and the female member is carried out. With this structure it is possible to push the slider forward by the thumb easily, so that the movement of the slider can be started easily.

According to the present invention, the slider which is attached to the fastener stringer is the one having a semi-automatic stopping device. When the engagement leg portion of the male member are engaged with the engagement hole of the female member in the left and right fastener stringers, and when the closing operation of the fastener chain is begun, the slider is in a release state. That is, when a pull of the slider is caused to fall to a shoulder side of the slider body, and when the pull is caused to stand on the slider body, a locking pawl of the slider is pulled up so as to maintain a state that the stop operation cannot be carried out. Consequently the pull of the slider is prevented from being an obstruction at the time of the engagement and release operation of the separable bottom end stop assembly, and the engaging mechanism is directly visible so that the engagement and release operation can be carried out quickly and easily.

DETAILED DESCRIPTION OF TYPICAL EMBODIMENTS

The following is a detailed description of aspects of the separable bottom end stop assembly of a slide fastener of the present invention with reference to the accompanying drawings.

Figure 1:
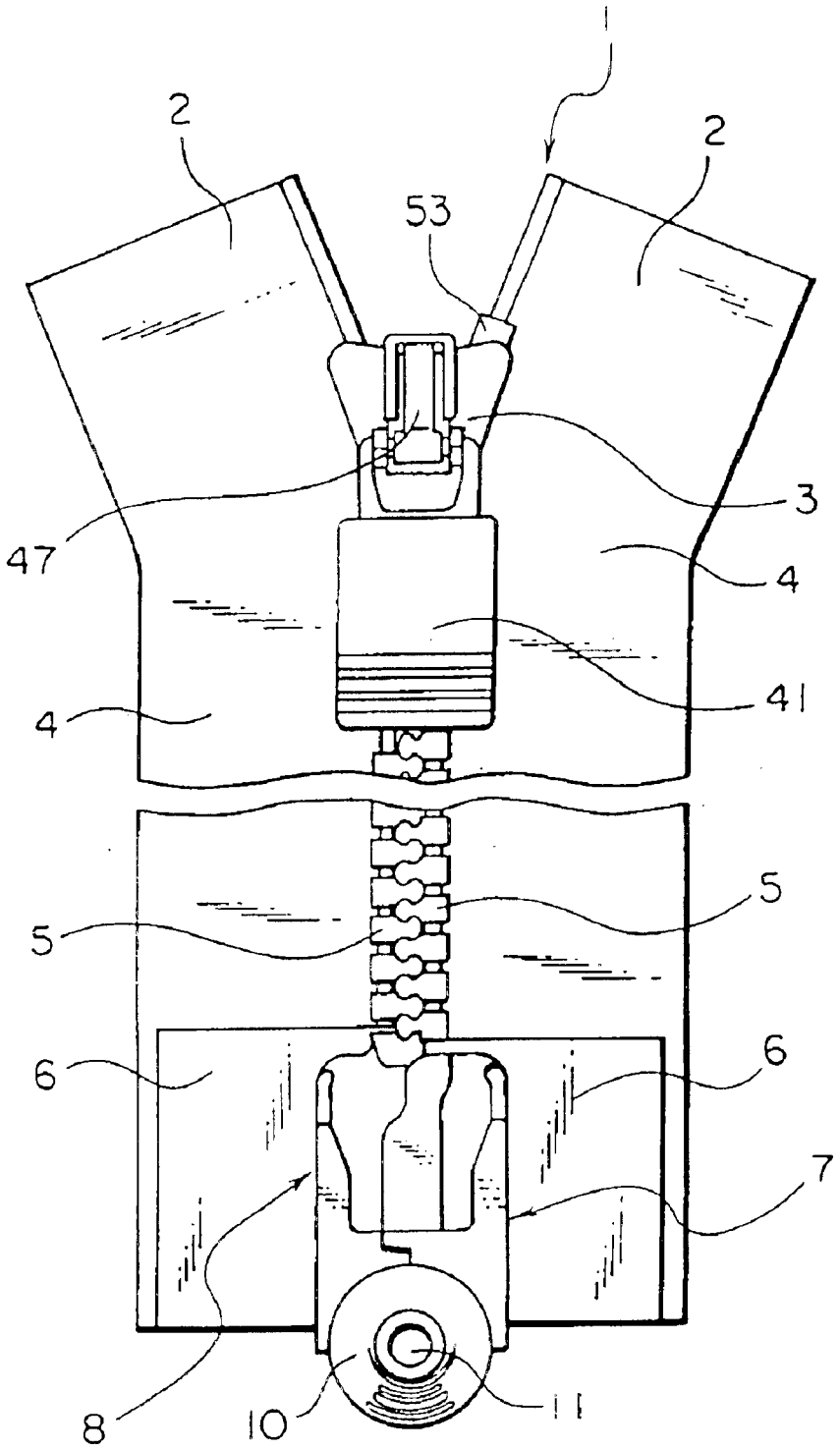
FIG. 1 is a front view of a slide fastener including the lateral-inserting type separable bottom end stop assembly according to a first embodiment of the present invention.

The separable bottom end stop assembly of a slide fastener according to the present invention is a lateral-inserting type shown in FIG. 1. In the separable bottom end stop assembly, a male member 7 and a female member 8 having a pin or an engagement leg portion 11 and a socket or an engagement hole 12 respectively are attached to disc-shaped slides plates 9 and 10 of left and right fastener stringers 2, 2 of the slide fastener. The sliding plates 9 and 10 of the male member 7 and the female member 8 are superposed and when pressed from both front and back directions, the engagement leg portion 11 and the engagement hole 12 are engaged, and at the same time the sliding plate 10 of the female member 8 is automatically rotated around the engagement leg portion 11 in a horizontal direction thereof. Consequently, an insert plate 30 of the female member 8 is inserted between guide flanges 44 of a slider 3 which is held by a holding portion 21 of the male member 7. The sliding plate 10 is further rotated automatically, so that the insert plate 30 is advanced into an inner portion of the slider. Subsequently, when a pull 41 of the slider 3 is pulled thereby sliding the slider, the insert plate 30 is inserted into a concave insert portion 22 of the male member 7, so that the fastener chain is thereby closed.

Respective end portions of fastener tapes 4, 4 are reinforced by pressing reinforcing tapes 6, 6 which are formed of thermoplastic resin films to both front and back surfaces of the fastener tapes 4, 4. The male member 7 and the female member 8 are formed integrally with front surfaces of the reinforcement tapes 6, 6 using thermoplastic resin such as polyamide, polyacetal, polypropylene, polybutylene terephthalate by injection molding means so to be continuous with the fastener elements 5. It is to be noted that the separable bottom end stop assembly may also be formed using thermohardening resin or formed by metal die-casting.

Figure 5:
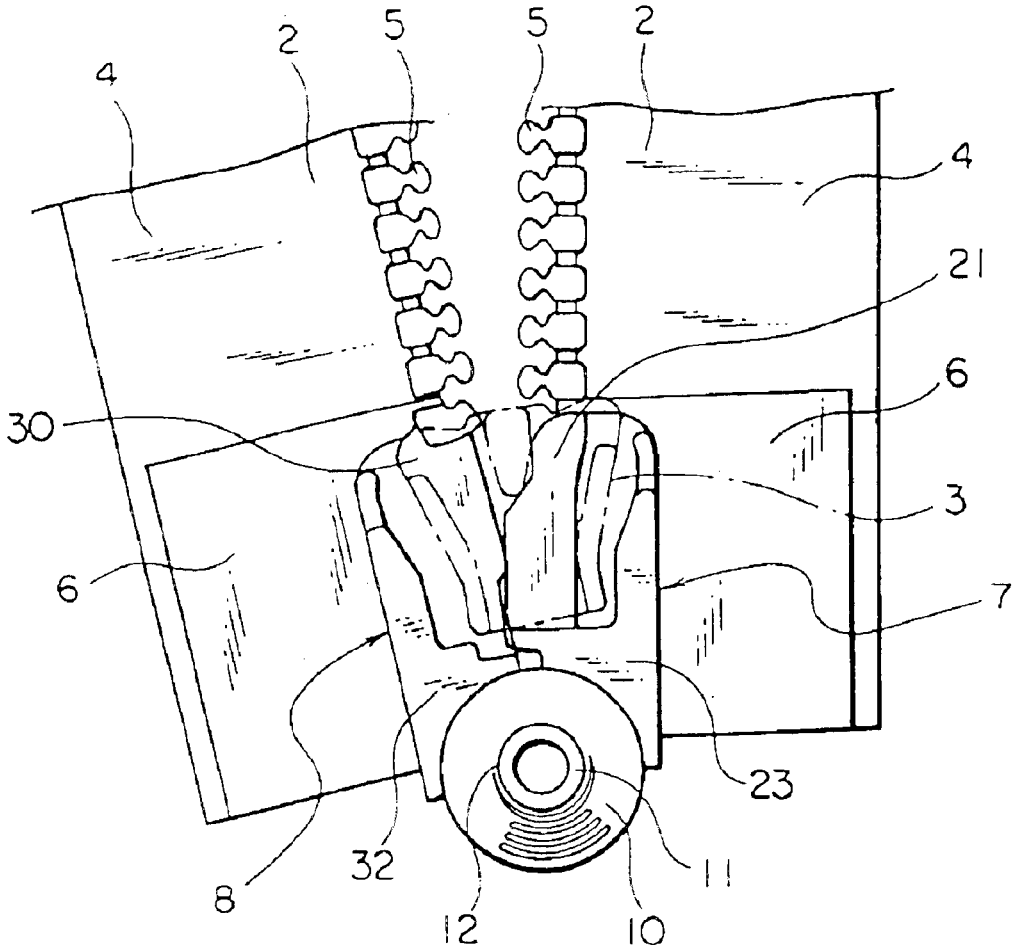
FIG. 5 is a front view of the state of the fastener chain immediately before the closing thereof.
Figure 6:
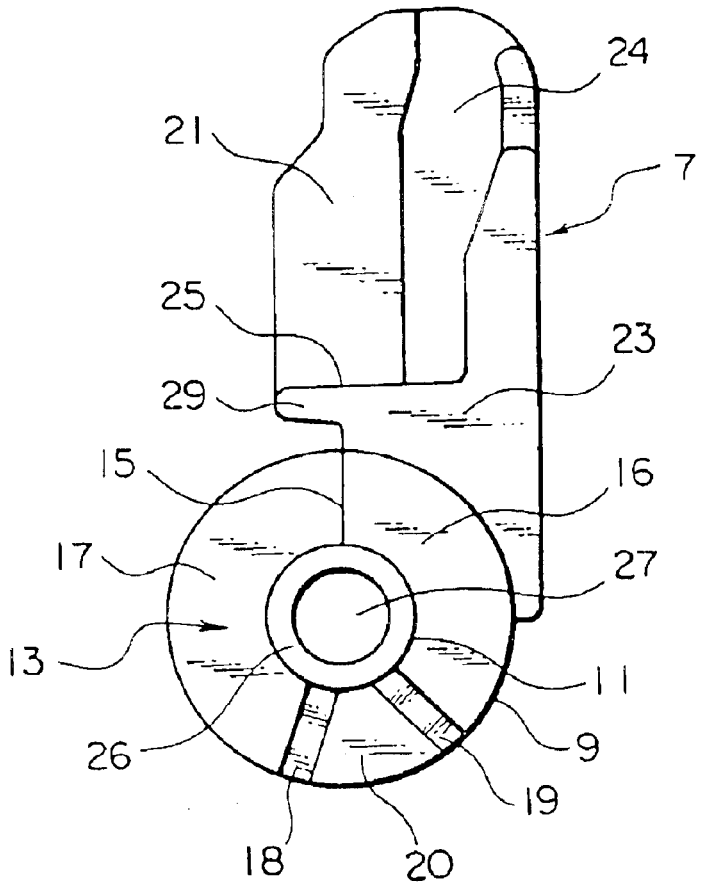
FIG. 6 is a front view of the male member of the first embodiment.
Figure 7:
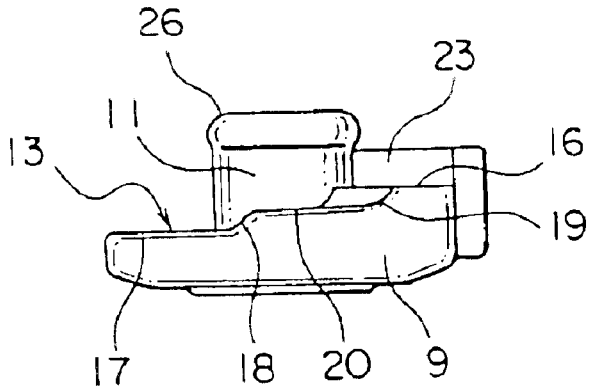
FIG. 7 is a bottom view of the male member of the first embodiment.

In the first embodiment of the separable bottom end stop assembly shown in FIGS. 2 to 14, the male member 7 which is attached so as to be integral with the end portion of one of the fastener stringers 2, is as shown in FIGS. 6 and 7, provided with a circular slide plate 9 at a front terminal end thereof. In the center of this slide plate 9, an engagement leg portion 11, which is a pin, is provided so as to project from the front surface thereof. An enlarged engagement head portion 26 is provided at a front end of the engagement leg portion 11 so as to project sideways. Further, a concave portion 27 is provided on an inner side surface of the engagement head portion 26.

At the periphery of the base portion of the engagement leg portion 11 of the slide plate 9, a slide surface 13 having a step is formed. This slide surface 13 is circular, and has a vertical surface 15 at the portion along the side edge of the fastener tape 4, that is, from the holding portion 21 side toward the center of the engagement leg portion 11. An upper step horizontal surface 16 and a lower step horizontal surface 17 are disposed such that the vertical surface 15 is interposed therebetween. The lower step horizontal surface 17 projects from the side edge of the fastener stringer 2 to the outer side thereof, while the upper step horizontal surface 16 is provided so as to be positioned from the side edge of the fastener stringer 2 toward the inner side thereof. A first steep incline surface 18 is provided at a position of approximately 165° from the vertical surface 15 in the horizontal direction. The first steep incline surface 18 is formed with an elevation angle approximately in the range from 50° to 70°. In a direction from the first steep incline surface 18 to the upper step horizontal surface 16, a gentle incline surface 20 having an elevation angle of approximately 5° to 10° is provided so as to extend between the ranges of approximately 50° and 60° about the center of the engagement leg portion 11. The terminal end of the gentle incline surface 20 is provided with a second steep incline surface 19 which has an elevation angle of 50–70° and this is provided so as to be continuous to the upper step horizontal surface 16. Consequently, a continuous slide surface 13 having a cam mechanism is formed.

A thick external portion 23 which protrude from the slide surface 13 is provided at the fastener element 5 side, and a stop portion 25 for stopping the slider 3 which is one step lower is provided at the external portion 23 close to the slide surface 13. The inner edge of the stop portion 25 extends to the upper end side so as to accommodate the guide flange 44 of the slider 3. Also, fastener elements 5 are attached continuously to the outer side of the stop portion 25. The stop portion 25 has a holding portion 21, which can hold the slider 3 and extends to the upper end side. Ann insert recess groove 22 is formed at the outer surface of the holding portion 21 such that the insert plate 30 of the female member 8 can be fit-inserted therein.

Figure 14:
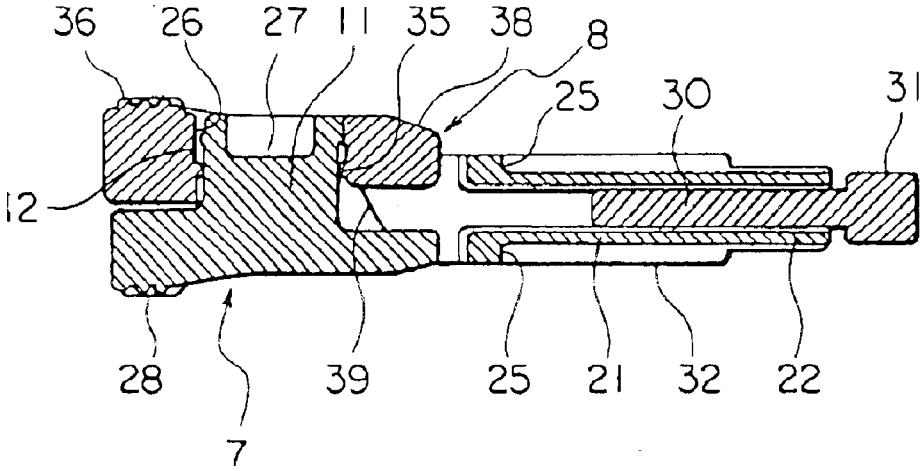
FIG. 14 is a cross section of the male member and the female member in an engaged state.

A guide surface 24, which can slide the guide flange 44 of the slider 3 having a concave surface, is formed between the holding portion 21 and the inner side edge of the stop portion 25. A convex portion 29 which projects from the vertical surface 15 to the side is formed at the external portion 23 of the lower end of the holding portion 21. This convex portion 29 can be fit-inserted into the concave portion 37 of the female member 8. As shown in FIG. 14, the back surface of the slide plate 9 projects to the outer side and forms a thick grip portion 28. The grip portion 28 has a plurality of grooves cut into the front surface thereof to provide a rough surface which prevents slipping so that the slide plate 9 can be easily gripped. In addition, the back surface of the slide plate 9 is formed with each of a thick external portion 23, a holding portion 21 for the slider 3, a guide surface 24 and a stop portion 25 in a similar manner to the front surface thereof.

Figure 8:
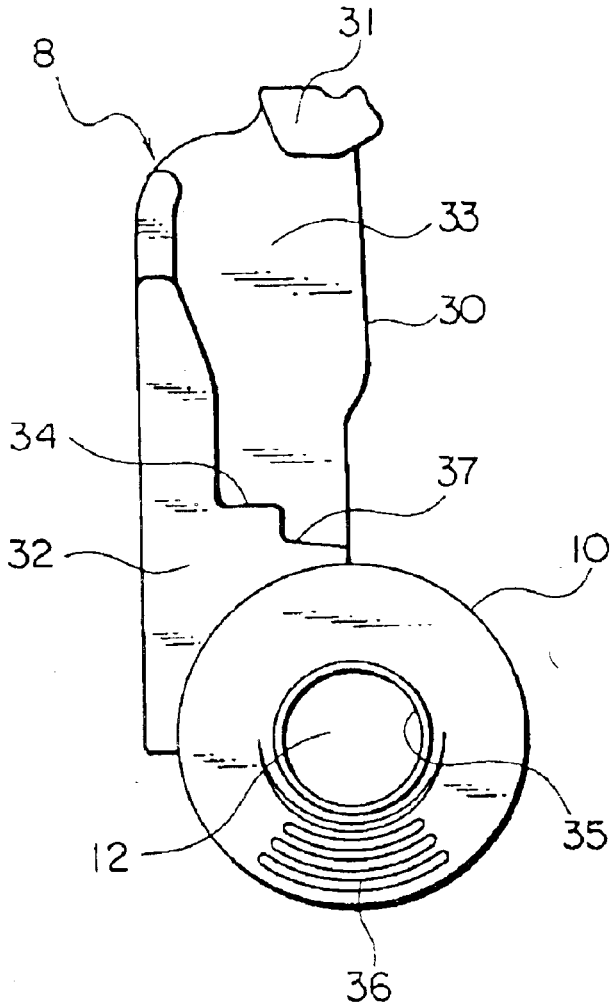
FIG. 8 is a front view of the female member of the first embodiment.
Figure 9:
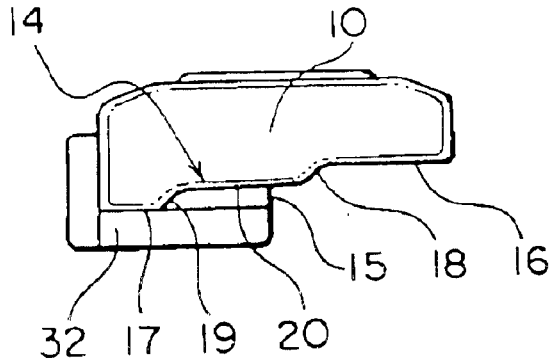
FIG. 9 is a bottom view of the female member of the first embodiment.
Figure 10:
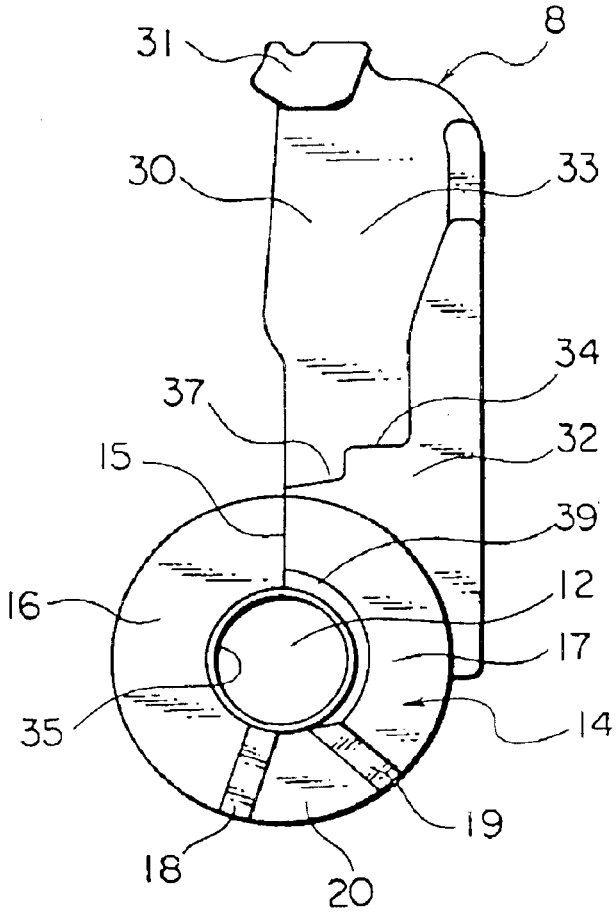
FIG. 10 is a rear view of the female member of the first embodiment.

A female member 8, which opposes the male member 7, is provided at the end portion of the other side fastener stringer 2. As shown in FIGS. 8, 9 and 10, the female member 8 has a circular slide plate 10 at the terminal end thereof, and an engagement hole 12 is formed in the center thereof as the socket. A small engagement ridge 35 is provided at the inner peripheral surface of the engagement hole 12 so as project toward the inner side from the thinnest portion thereof. This engagement ridge 35 engages with the engagement head portion 26 of the engagement leg portion 11 of the male member 7.

The back side of this slide plate 10, that is, the front surface which opposes the slide surface 13, has a slide surface 14, which has a step formed at the periphery of the engagement hole 12. The slide surface 14 is circular and has a vertical surface at the portion along the side edge of the fastener tape 4, that is, from the insert plate 30 side to the center of the engagement hole 12. As with the slide surface 13 of the male member 7, an upper step horizontal surface 16 and a lower step horizontal surface 17 are disposed such that the vertical surface 15 is interposed therebetween. The upper step horizontal surface 16 projects from the side edge of the fastener stringer 2 to the outer side thereof, while the lower step horizontal surface 17 is provided so as to be positioned from the side edge of the fastener stringer 2 toward the inner side thereof. The upper step horizontal surface 16 has a first steep incline surface 18 at a position of approximately 165° from the vertical surface 15 in the horizontal direction thereof. The first steep incline surface 18 is formed with an elevation angle approximately in the range from 50° to 70°. In a direction from the incline surface 18 to the lower step horizontal surface 17, a gentle incline surface 20 having an elevation angle of approximately 5° to 10° is provided so as to extend between the ranges of approximately 50° and 60° about the center of the engagement leg portion 11. The terminal end of gentle incline surface 20 is provided with a second steep incline surface 19 which has an elevation angle of 50–70° and this is provided so as to be continuous to the lower step horizontal surface 17. Consequently, a continuous slide surface 14 having a cam mechanism is formed.

The slide surface 14 around the engagement hole 12 is provided with a suitable beveling 39 in a range from the thickest lower step horizontal surface 17 to the gentle incline surface 20 which is the second thickest and from the front surfaces of these surface to the engagement ridge 35 provided at the inner peripheral surface, so that the engagement head portion 26 of the male member 7 can be easily fit therein.

A thick external portion 32 which protrude from the slide surface 14 to the surface, that is, the surface which opposes the slide surface 13, is provided at the fastener element 5 side, and a stop portion 34 for stopping the slider 3 which is one step lower is provided at the external portion 32 close to the slide surface 14. The inner side edge of the stop portion 34 extends to the upper end and can accommodate the slider 3. Also, an insert plate 30 having a flat guide surface 33 is formed at the front surface, so that the insert plate 30 can be inserted into the insert recess groove 22 of the male member 7. Also, the upper end of the outer side edge of the insert plate 30 has a coupling portion 31 which can couple with the opposing fastener element 5. Further, a concave portion 37 is provided near the front end of the stop portion 34 and can thus be fit together with the convex portion 29 of the male member 7.

As shown in FIG. 14, the front surface of the slide plate 10 is formed with a thick grip portion 36 at an outermost end thereof so as to project to the outer side. The grip portion 36 has a plurality of grooves cut into the front surface thereof to provide a rough surface which prevents slipping. The surface of the slide plate 10 in which the opposite sides of the grip portion 36 and the engagement hole 12 are joined is at a higher position than the external portion 32 as shown in FIG. 14, and accordingly, the external portion 32 is lower than the slide portion 10. In addition, an incline surface 38 which inclines gently toward the external portion 32 is formed at the end side. By providing this incline surface 38, when the male member 7 and the female member 8 are pressed together from the front and back with the fingers, the fingers can slide on the incline surface 38, so that the slider 3 can be pushed forward when the closing operation of the fastener chain 1 is carried out.

The external portion 32 has a stop portion 34 for stopping the slider close to the slide plate 10, and a concave portion 37 is provided close to the front end of the stop portion 34. The side edge of the external portion 37 extends to the upper end side and is formed so as to accommodate the slider 3. The front surface of the external portion 37 has a flat guide surface 33 and thus the insert plate 30 is formed. Further, the coupling portion 31 is provided at the upper end of the outer side edge of the insert plate 30. The back side of these parts are configured in the same manner.

Figure 15:
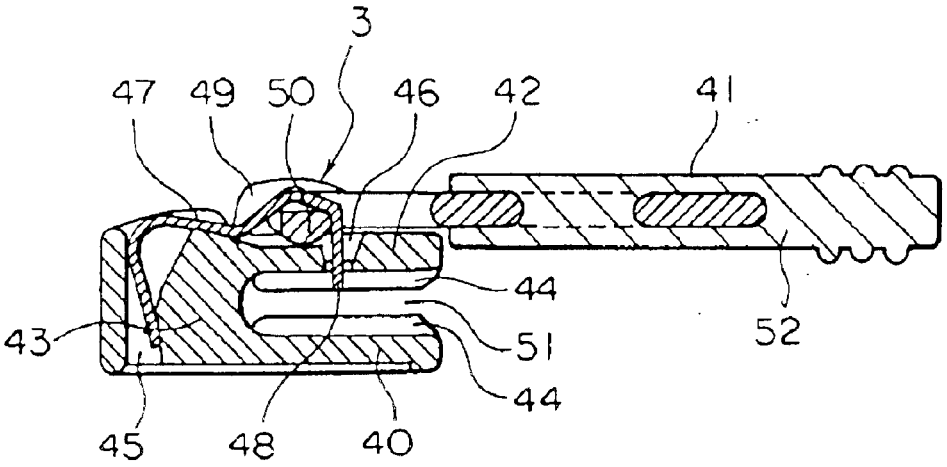
FIG. 15 is cross section of the slider having a semiautomatic stop device.

Next, as shown in FIG. 15, the slider 3 which is fit-inserted and used in the fastener chain 1 having a male member 7 and a female member 8 is a slider having a semi-automatic stopping device and is generally called a semi-automatic slider. The slider 3 has an accommodation hole 45 through which a guide pillar 43 of the body 40 and the upper wing plate 42 has a pair of mounting portions 49 for mounting a pull 41. A claw hole 46 is formed at a rear opening side of the slider close to the mounting portions 49. A plate spring 47 which is to be mounted to the body 40 has an M-shaped cross section, and one end thereof is accommodated and fixed in the accommodating hole 45 while the other end has a locking pawl 48 which fits into the claw hole 46. A pull 41 having a semicircular-shaped cam 50, whose pivot is formed above the locking pawl 48, is disposed at the lower side of the plate spring 47 and attached to the attachment portion 49. A rubber plate 52 is attached to the pull 41 so as to impart flexibility thereto.

When the slider 3 causes the pull 41 to become upright from the body 40 and when the pull 41 is caused to fall at the shoulder side, that is, in the forward direction, the plate spring 47 is automatically lifted up by the semicircular cam of the pull 41, so that the locking pawl 48 is caused to come up out of the guide groove 51 of the body 40. As a result, the slider 3 is slid automatically. When the slider 3 is to be stopped, because if the pull 41 is disposed in a hanging state with respect to the body 40, the cam 50 does not operate. Therefore the locking pawl 48 is inserted between the fastener elements and the slider 3 is stopped.

Figure 2:
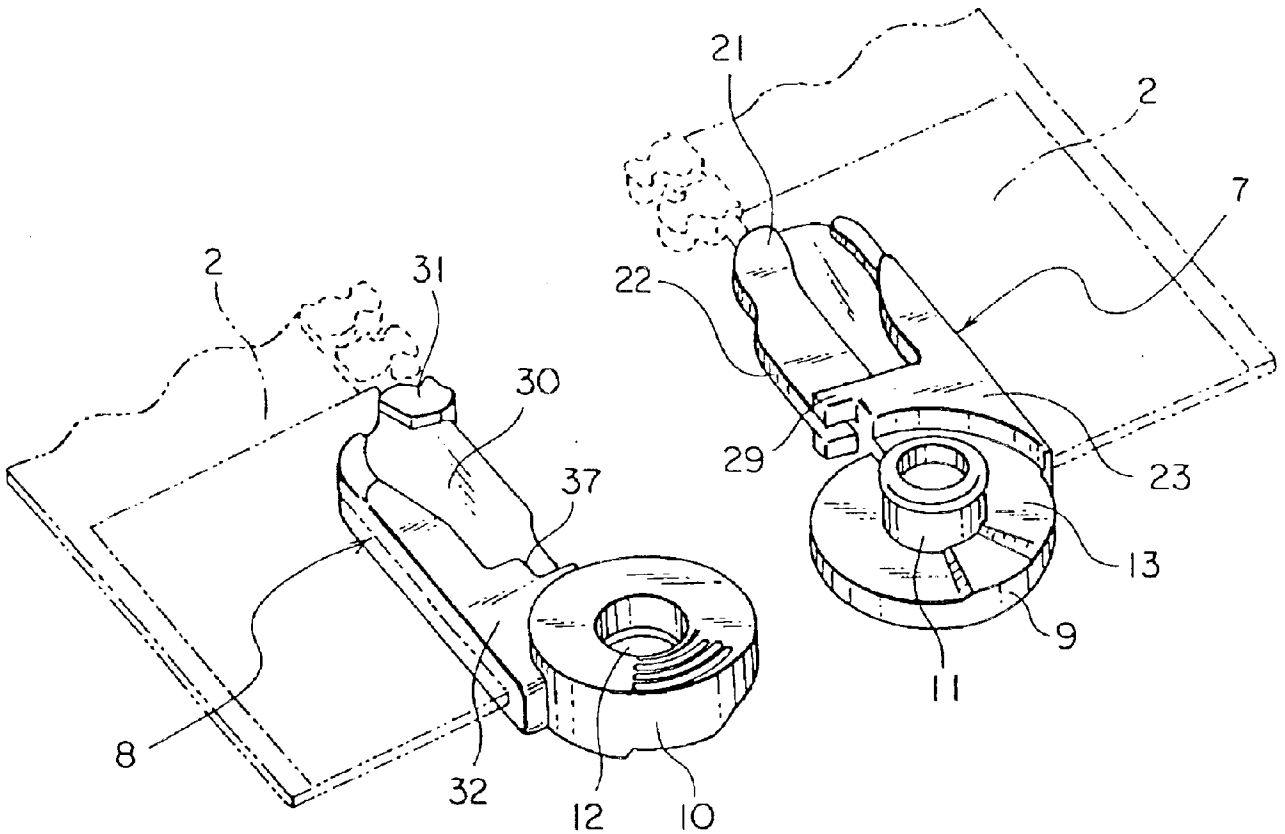
FIG. 2 is a perspective view of a male member and a female member in a state in which the left and right fastener stringers are separated.
Figure 3:
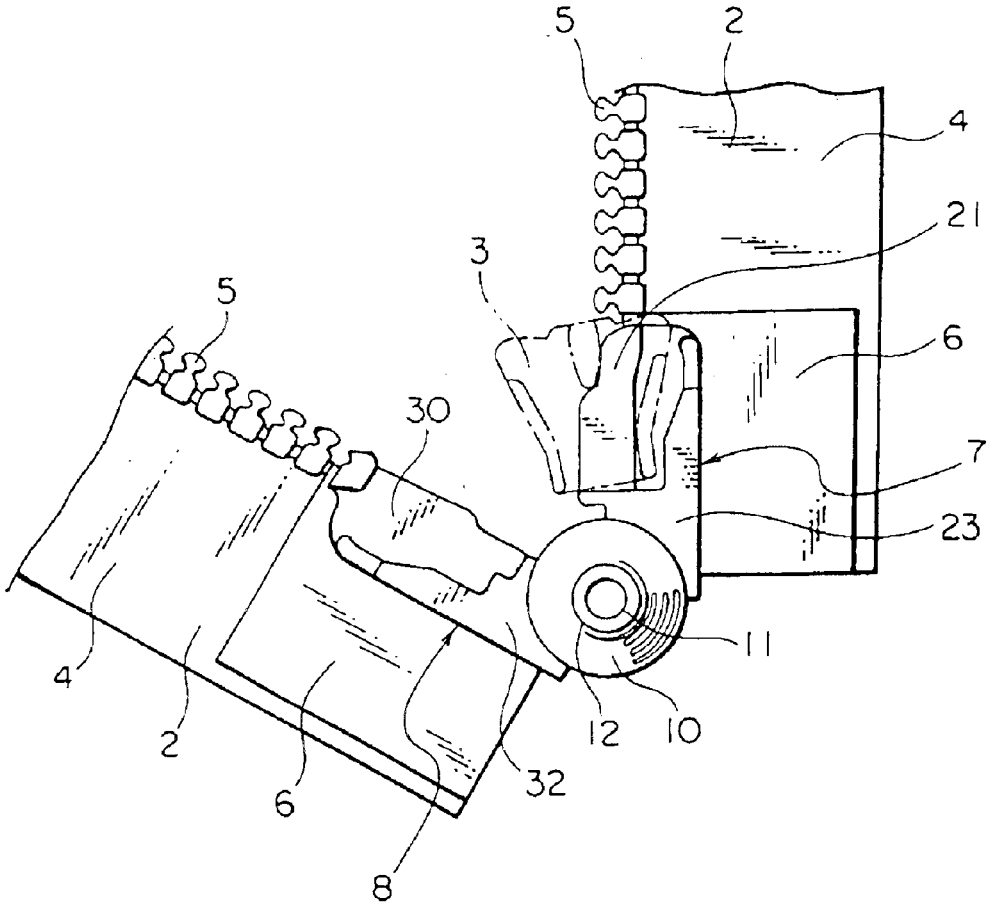
FIG. 3 is a front view of the fastener chain in an open state.
Figure 13:
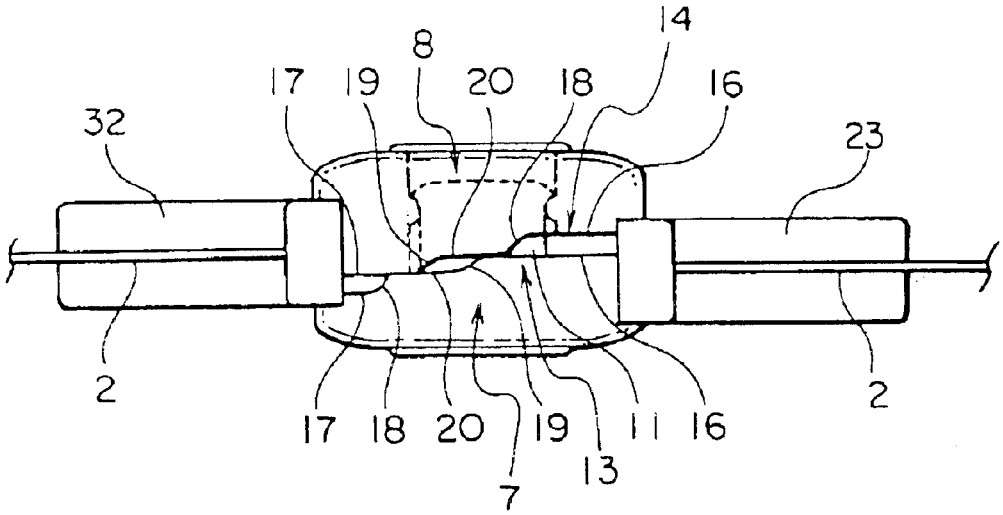
FIG. 13 is a bottom view of the separable bottom end stop at the time of opening of the fastener chain of the first embodiment.

The following describes the separable bottom end stop assembly of the present invention in a state of use. FIG. 2 shows a state in which the male member 7 and the female member 8 attached to fastener stringers 2, 2 are separated. From this state, first the slider 3 which has been inserted through the fastener stringer 2 having the male member 7 is pulled down to the holding portion 21 of the male member 7 and held therein. While the slider 3 causes the pull 41 to stand upright from the body 40 or when the pull 41 caused to fall to the shoulder side, the right and left fastener stringers 2, 2 are opened at approximately 70° about the center of the slide plate 9 or 10 as shown in FIG. 3. In this state, when the engagement leg portion 11 of the male member 7 and the engagement hole 12 of the female member 8 are brought together and then forcefully pressed together, as shown in FIG. 13, the engagement head portion 26 and the engagement ridge 35 are engaged and cannot be removed from each other. At this time, the positional relationship between the slide surface 13 and the slide surface 14 is such that the gentle incline surface 20 of the slide surface 13 and the lower step horizontal surface 17 of the slide surface 14 are joined together and the gentle incline surface 20 of the slide surface 14 and the upper step horizontal surface 16 of the slide surface 13 are joined together.

Figure 4:
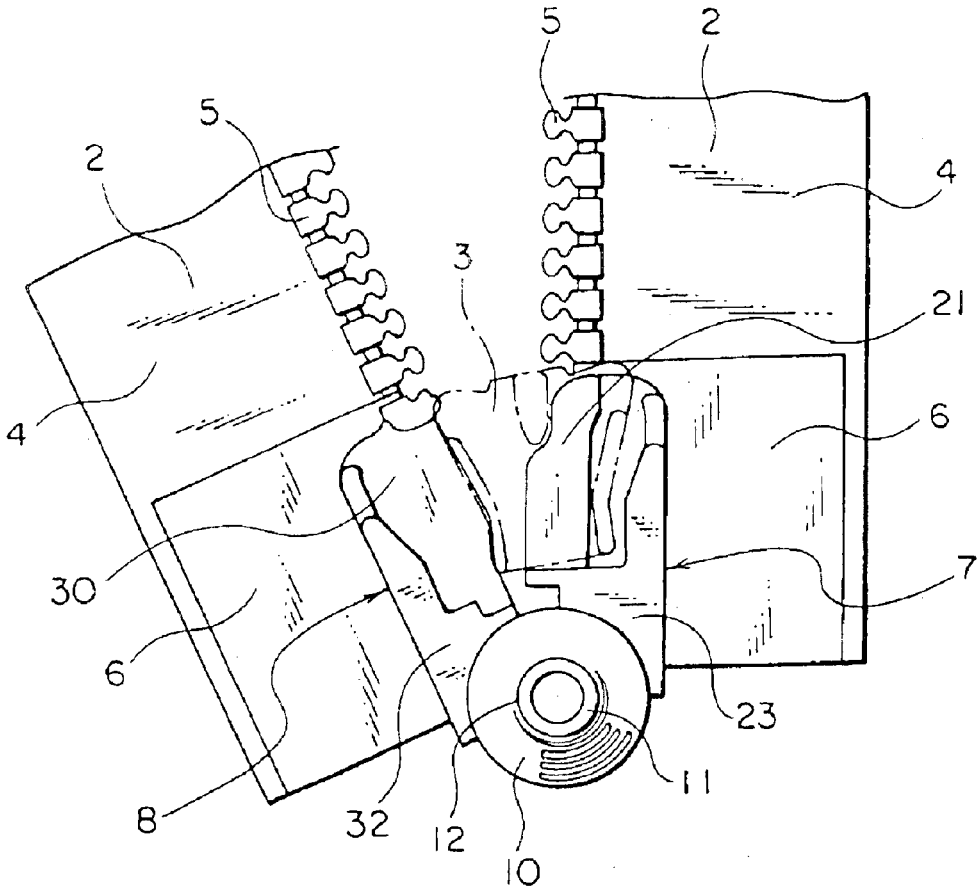
FIG. 4 is a front view of the state of the fastener chain immediately before the insert plate is inserted into the slider.

When the slide plates 9 and 10 of the male member 7 and the female member 8 are forcefully pressed from the back and front, the gentle incline surface 20 causes a force to be generated, which attempts to rotate the slide plate 10 of the female member 8 around the engagement leg portion 11. The gentle incline surface 20 of the slide surface 14 of the female member 8 slides on the upper step horizontal surface 16 of the slide surface 13 of the male member 7, and the lower step horizontal surface 17 of the slide surface 14 of the female member 8 slides and moves on the gentle incline surface 20 of the slide surface 13 of the male member 7. When the steep incline surfaces 18 and 19 of both the slide surfaces 13 and 14 contact with each other, the slide plate 10 moves forcefully along the incline surfaces 18 and 19 in front and back directions thereof. As a result, a great rotational force is applied to the slide plate 10, and as shown in FIG. 4, the female member 8 is rotated until the front end of the insert plate 30 is positioned between the flanges 44 of the slider 3. The positional relationship between the slide surface 13 and the slide surface 14 at this time, is as shown in FIG. 12, such that the gentle incline surface 20 of the slide surface 13 contacts with the gentle incline surface 20 of the slide surface 14, and the first steep incline surface 18 of the slide surface 13 contacts the second steep incline surface 19 of the slide surface 14 and the second steep incline surface 19 of the slide surface 13 contacts the first steep incline surface 18 of the slide surface 14, and there are small gaps between the upper step horizontal surface 16 of the slide surface 13 and the upper step horizontal surface 16 of the slide surface 14 and between the lower step horizontal surface 17 of the slide surface 13 and the lower step horizontal surface 17 of the slide surface 14.

Subsequently, by the movement of the gentle incline surface 20 of the slide surface 14 of the female member 8 along the gentle incline surface 20 of the slide surface 13 of the male-member 7, the rotational force applied to the female member 8 is maintained and further rotates the female member 8. Then, as shown in FIG. 5, the insert plate 30 is guided and inserted to the inner portion of the slider 3. In addition, when the slider 3 is pulled up and the left and right fastener stringers 2, 2 are closed, the vertical surfaces 15, 15 of the male member 7 and the female member 8 are brought into contact with each other. At this time, the positional relationship between the slide surface 13 and the slide surface 14 is such that the lower step horizontal surface 17 of the slide surface 13 and the lower step horizontal surface 17 of the slide surface 14, and also the upper step horizontal surface 16 of the slide surface 13 and the upper step horizontal surface 16 of the slide surface 14 are in contact with each other. The steep incline surface 18, the gentle incline surface 20 and the second steep incline surface 19 of the slide surface 13 oppose the second steep incline surface 19, the gentle incline surface 20 and the first steep incline surface 18 of the slide surface 14 with a small space between each of them.

Figure 11:
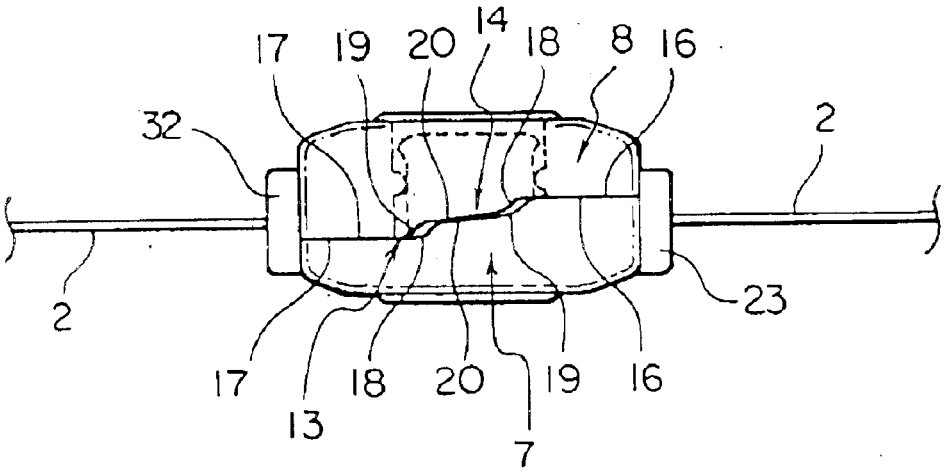
FIG. 11 is a bottom view of the separable bottom end stop assembly at the time of closing of the fastener chain of the first embodiment.
Figure 12:
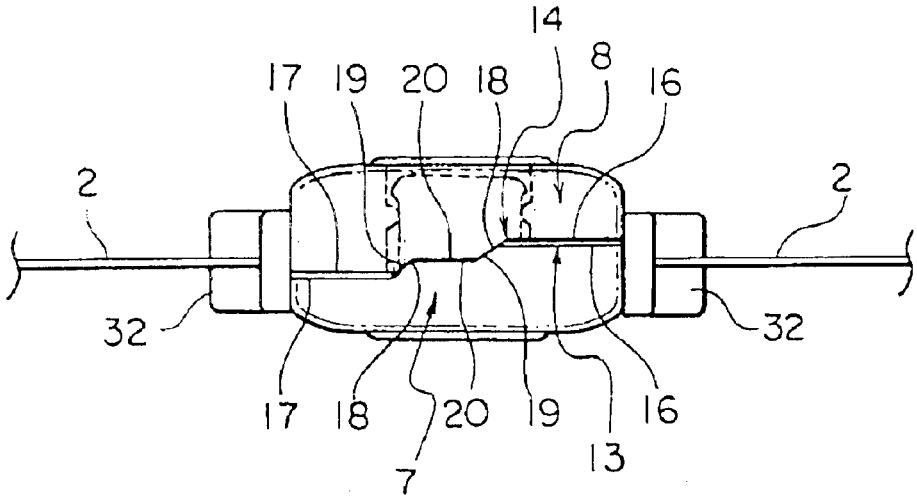
FIG. 12 is a bottom view of the separable bottom end stop immediately before the closing of the fastener chain of the first embodiment.

As can also be understood from the above description, even when the male member 7 and the female member 8 are rotated from the state shown in FIGS. 4 and 12 to the state shown FIGS. 1 and 11, the male member 7 and the female member 8 do not move relatively in a vertical direction, but move only in the horizontal direction. Accordingly in the state of FIG. 4, the side edge of the insert plate 30 of the female member 8 oppose the insert recess groove 22 of the male member 7 between the guide flanges 44 of the slider 3 and can move horizontally to be inserted therein.

Immediately before the state shown in FIG. 4, the first steep incline surface 18 and the second steep incline surface 19 of the slide surface 13 of the male member 7 are about to oppose and contact the second steep incline surface 19 and the first steep incline surface 18 of the slide surface 14 of the female member 8. By pressing the slide plate 9 of the male member 7 and the slide plate 10 of the female member 8 at the back and front thereof with even one hand, the steep incline surfaces contact each other and due to the action of the cam, the insert plate 30 is quickly led between the guide flanges 44 of the slider 3. At this time force is applied by bringing the male member 7 close to the female member 8 on the back side thereof by using the index finger. Further by pushing the front surface of the female member 8 with the thumb forward, the rear opening portion of the slider 3 is pressed with the force and the slider 3 can be slid forward to a small extent with only one hand. As a result, the right and left fastener stringers 2, 2 couple with each other by engagement of the fastener elements 5, and thus subsequently if the pull 41 of the slider 3 is pulled forward, the fastener chain 1 can be closed as shown in FIG. 1.

When the fastener chain 1 is to be separated, the slider 3 is pulled down to the holding portion 21 of the male member 7. Then in a state in which the pull 41 is upright or made to fall towards the shoulder side, the female member 8 is opened and separated in the horizontal direction with respect to the male member 7. As a result, the second steep incline surface 19 of the slide surface 13 and the second steep incline surface 19 of the slide surface 14 contact each other. Due to the action of the cam, the engagement head portion 26 of the engagement leg portion 11 and the engagement projection 35 of the engagement hole 12 are automatically released, so that the slide plate 10 of the female member 8 can be easily removed from the slide plate 9 of male member 7. It is to be noted that the reference number 53 shown in FIG. 1 represents a top end stop for preventing the slider 3 from coming off from the stringer 2.

Figure 16:
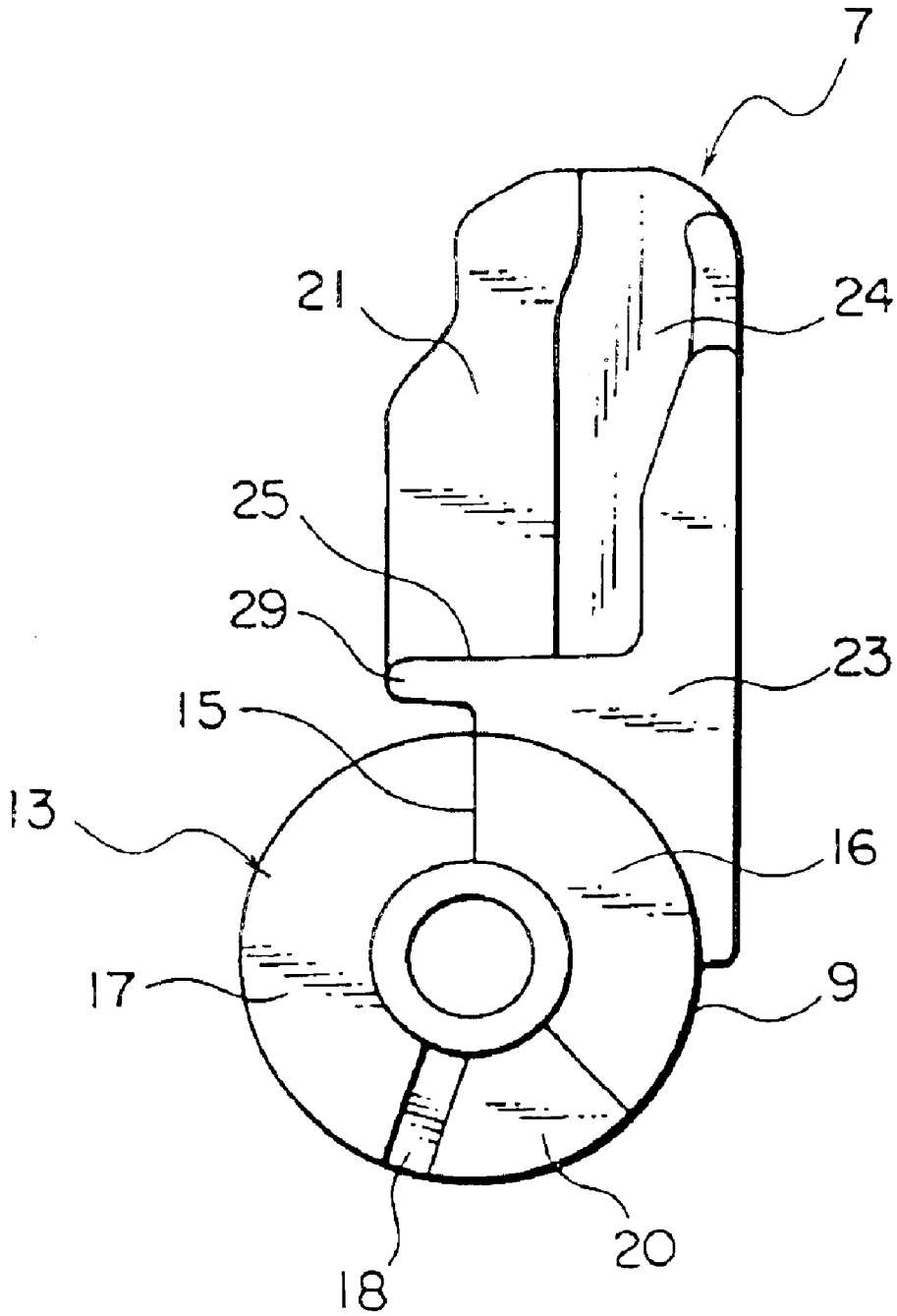
FIG. 16 is a front view of a male member according to a second embodiment.

Finally the second embodiment of the separable bottom end stop assembly is shown in FIGS. 16 to 20, which is the same as that of the first embodiment except that configurations of the slide surfaces 13 and 14 of the sliding plates 9 and 10 on the male member 7 and the female member 8. The slide surface 13 of the male member 7 is, as shown in FIG. 16, formed with a vertical surface 15 at the holding portion 21 side, on opposite sides of which an upper step horizontal surface 16 and a lower step horizontal surface 17 are formed through a step. A steep incline surface 18 is provided at the lower step horizontal surface 17 so as to be disposed at a position of approximately 165° from the vertical surface 15 in the horizontal direction. The first steep incline surface 18 is formed with an elevation angle approximately in the range from 50° to 70°. In a direction from the incline surface 18 to the upper step horizontal surface 16, a gentle incline surface 20 having an elevation angle of approximately 50 to 10° is provided so as to extend between the ranges of approximately 50° and 60° about the center of the engagement leg portion 11. The gentle incline surface 20 is continuous to the upper step horizontal surface 16. As a result, a slide surface 13 provided with a cam mechanism is formed. Thus the difference between the first embodiment is in that the terminal end of the gentle incline surface 20 is not provided with a steep incline surface but contacts the upper step horizontal surface 16.

Figure 17:
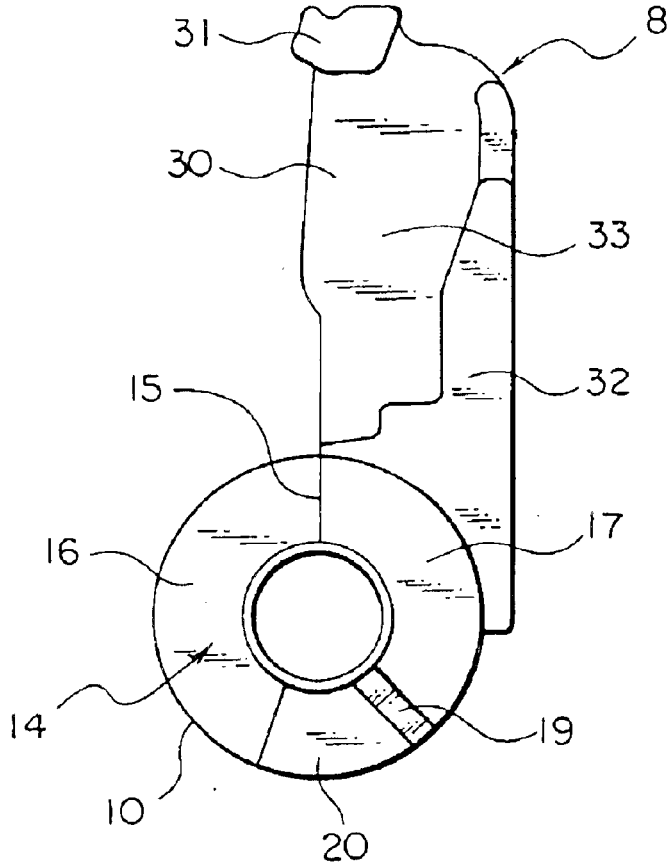
FIG. 17 is a rear view of a male member of the second embodiment.

In addition, as shown in FIG. 17, the slide surface 14 of the female member 8 has a vertical surface 15 at the insert plate 30 side thereof. This vertical surface 15 is formed between the upper step horizontal surface 16 and the lower step horizontal surface 17. A steep incline surface 19 is provided at the lower step horizontal surface 17, which is at a position of approximately 165° from the vertical surface 15 in the horizontal direction thereof. The steep incline surface 19 is formed with an elevation angle approximately in the range from 50° to 70°. In a direction from the steep incline surface 19 to the upper step horizontal surface 16, a gentle incline surface 20 having an elevation angle of approximately 5° to 10° is provided so as to extend between the ranges of approximately 50° and 60° about the center of the engagement hole 12. The terminal end of the gentle incline surface 20 connects to the upper step horizontal surface 16. As a result, a slide surface 14 provided with a cam mechanism is formed. Thus the difference between this second embodiment and the first embodiment is in that the terminal end of the gentle incline surface 20 is not provided with a steep incline surface but contacts the upper step horizontal surface.

Figure 18:
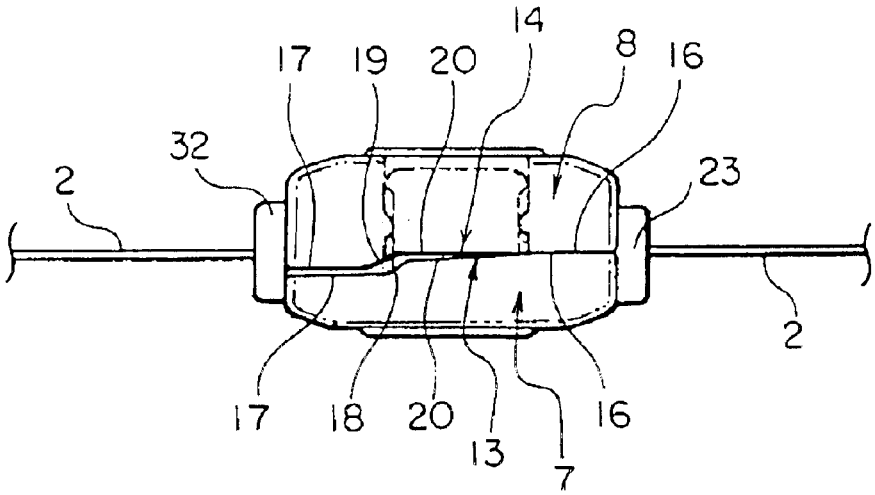
FIG. 18 is a bottom view of the separable bottom end stop assembly at the time of closing of the fastener chain of the second embodiment.
Figure 19:
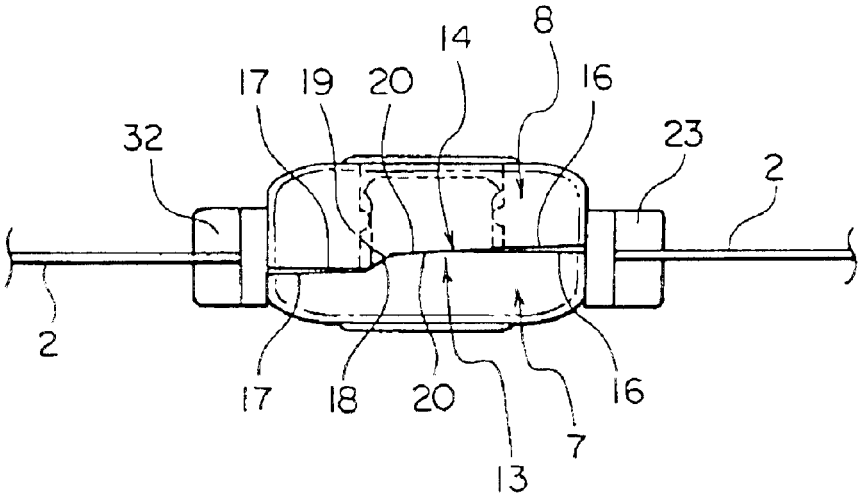
FIG. 19 is a bottom view of the separable bottom end stop assembly immediately before closing of the fastener chain of the second embodiment.
Figure 20:
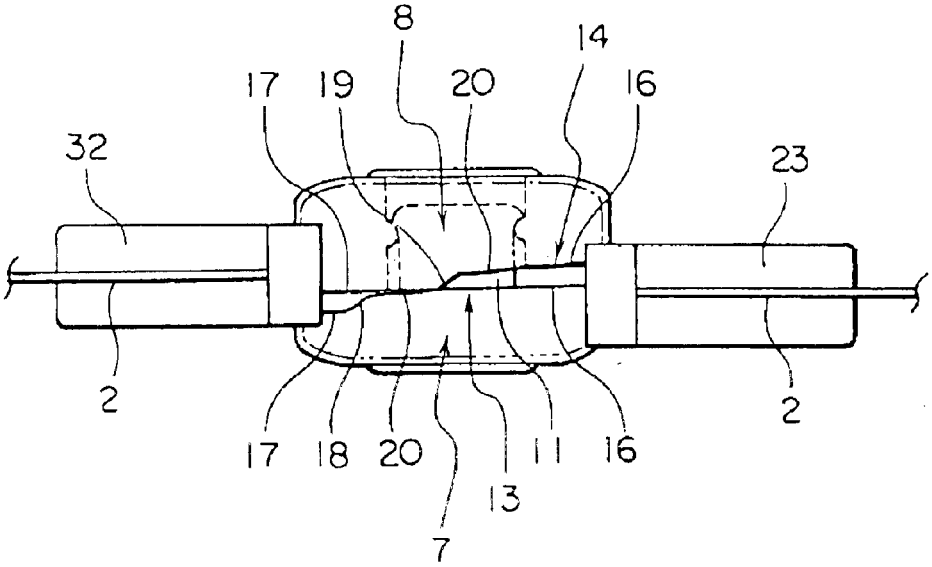
FIG. 20 is a bottom view of the separable bottom end stop assembly at the time of opening of the fastener chain of the second embodiment.
Figure 21:
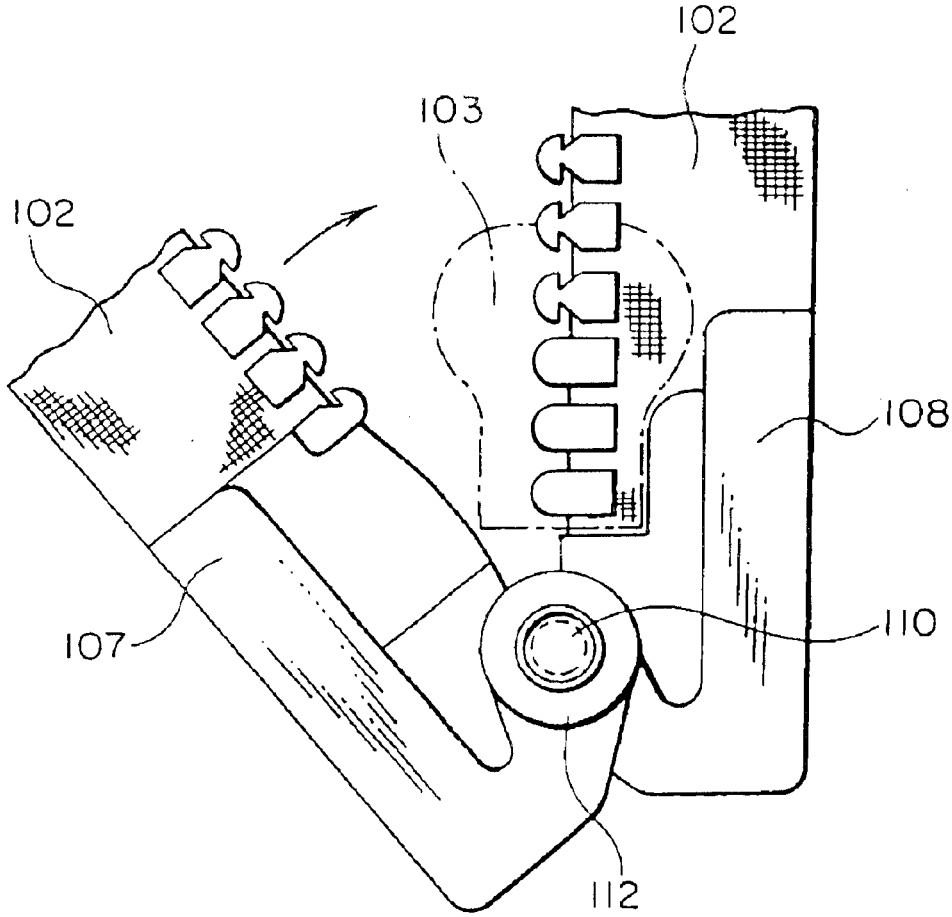
FIG. 21 PRIOR ART
FIG. 21 is a front view of the male member and the female member of a known separable bottom end stop assembly in a state in which they are engaged.

The positional relationship of the joining of the slide surface 13 of the male member 7 and the slide surface 14 of the female member 8 according to the second embodiment will be described in the following. In order to engage the engagement head portion 26 of the engagement leg portion 11 and the engagement ridge 35 of the engagement hole 12, as shown in FIG. 20, the engagement is carried out at the time when the steep incline surface 19 of the slide surface 14 joins with the gentle incline surface 20 of the slide surface 13. In the state when the insert plate 30 is inserted between the guide flanges 44 of the slider 3, as shown in FIG. 19, the steep incline surface 18 and the gentle incline surface 20 of the slide surface 13 oppose and come in contact with the gentle incline surface 20 and the steep incline surface 19 of the slide surface 14 and there are small gaps between the upper step horizontal surface 16 of the slide surface 13 and the upper step horizontal surface 16 of the slide surface 14 and between the lower step horizontal surface 17 of the slide surface 13 and the lower step horizontal surface 17 of the slide surface 14. In addition, in the state in which the vertical surfaces 15 are in contact with each other, when the slide surfaces 13 and 14 are joined together, there is a small space between the steep incline surface 18 and the gentle incline surface 20 of the slide surface 13, and the steep incline surface 19 and the gentle incline surface 20 of the slide surface 14, as shown in FIG. 18.

Even with the above-described configurations of the slide surface 13 of the male member 7 and the slide surface 14 of the female member 8, when the slide plate 9 of the male member 7 and the slide plate 10 of the female member 8 are, as is the case in the first embodiment, pressed at the front and back with only one hand while the male member 7 and the female member 8 are at such a position as being opened at approximately 30°, the steep incline surfaces 18 and 19 can be brought into contact with each other. Due to the action of the cam, the insert plate 30 can be led speedily between the guide flanges 44 of the slider 3. Further force is applied by using the index finger to bring the female member 8 close the male member 7, and by pushing the front surface of the female member 8 with the thumb forward, the rear opening portion of the slider 3 is pressed with force, so that the slider 3 can be easily slid forward to a small extent with only one hand, thus completing the fitting together of the male member 7 and the female member 8.

Further, in order to separate and release the male member 7 and the female member 8, from the state shown in FIG. 20, if they are opened by about 90° for example, the lower end corner portion of the steep incline surface 19 of the female member 8 abuts the gentle incline surface 20 of the male member 7 near the terminal end thereof. Consequently, the female member 8 is pushed upwards and the engaged state of the engagement head portion 26 of the engagement leg portion 11 and the engagement projection 35 of the engagement hole 12 is released, and the female member 8 is taken out and thus released.

It is to be noted that the steep incline surface 18, 19, the gentle incline surface 20 and the limiting conditions of the specified angles adopted in this invention can be suitably modified in accordance with the size of the fastener chain, the various uses of the fastener and the needs of the customers. However it is necessary to provide the cam mechanism.

What is claimed:

1. A separable bottom end stop assembly for a slide fastener comprising a male member and a female member which are engageable with and releasable from each other, in which said male member is provided with a first slide plate from which an engagement leg portion projects, said female member is provided with a second slide plate in which an engagement hole is formed to be fitly engaged with the engagement leg portion, first and second sliding surfaces are respectively formed at peripheries of the engagement leg portion and the engagement hole, and at the time of engagement, the male member and the female member are rotatable respectively with the first and second slide surfaces and being in slide contact with each other, wherein each of the first and second slide surfaces is formed with at least one steep incline surfaces is continuous to a gentle incline surface, said steep incline surface and said gentle incline surface automatically advancing an insert plate which is disposed at one of the male member and the female member to an inside of a slider which is held by a holding portion which is disposed at the other of the male member and the female member when said first and second slide plates are pressed from both surfaces thereof.

2. The separable bottom end stop assembly for a slide fastener according to claim 1, wherein the steep incline surface is continuous to the gentle incline surface, and the steep incline surface automatically advances the insert plate toward the slider which is held at the holding portion when the first and second sliding plates are pressed from both surfaces thereof, and the gentle incline surface automatically guides the insert plate to the inside of the slider.

3. The separable bottom end stop assembly for a slide fastener according to claim 1, wherein the steep incline surface inclines at angle of 50° to 70°, and the gentle incline surface inclines at an angle of 50° to 10°.

4. The separable bottom end stop assembly for a slide fastener according to claim 1, wherein each of the slide surfaces includes an upper step horizontal surface and a lower step horizontal surface which are disposed through a step, and said steep incline surface includes a first steep incline surface and a second steep incline surface, said first steep incline surface, said gentle incline surface, and said second steep incline surface, which incline at different angles with respect to both the upper and lower step horizontal surfaces, being provided successively in a direction from the lower step horizontal surface to the upper step horizontal surface.

5. The separable bottom end stop assembly for a slide fastener according to claim 1, wherein each of the slide surfaces includes an upper step horizontal surface and a lower step horizontal surface which are disposed through a step, said steep incline surface and said gentle incline surface, which incline at different angles with respect to both the upper and lower step horizontal surfaces, being provided successively in a direction from the lower step horizontal surface to the upper step horizontal surface.

6. The separable bottom end stop assembly for a slide fastener according to claim 4 or 5, wherein each of the first and second slide surfaces is provided with a vertical surface at a side of said holding portion or said insert plate, and the upper step horizontal surface and the lower step horizontal surface are provided on both sides of said vertical surface, and said steep incline surface is provided so as to have a starting point between 160° and 170° from the vertical surface about a center of the engagement leg portion and the engagement hole, and the gentle incline surface is provided between 50° to 60° from an end point of the steep incline surface.

7. The separable bottom end stop assembly for a slide fastener according to claim 1, wherein the steep incline surface on the fist slide plate contacts the steep incline surface on the second slide plate while the gentle incline surface on the first slide plate contacts the gentle incline surface on the second slide plate.

* * * * *